US007780843B2

(12) United States Patent
Strack et al.

(10) Patent No.: US 7,780,843 B2
(45) Date of Patent: Aug. 24, 2010

(54) METHOD FOR PROCESSING HYDROCARBON PYROLYSIS EFFLUENT

(75) Inventors: Robert David Strack, Houston, TX (US); David R. Spicer, Houston, TX (US); George Stephens, Humble, TX (US); James Mitchell Frye, Houston, TX (US)

(73) Assignee: ExxonMobil Chemical Company Patents Inc., Houston, TX (US)

( * ) Notice: Subject to any disclaimer, the term of this patent is extended or adjusted under 35 U.S.C. 154(b) by 1053 days.

(21) Appl. No.: 11/178,025

(22) Filed: Jul. 8, 2005

(65) Prior Publication Data

US 2007/0007173 A1 Jan. 11, 2007

(51) Int. Cl.
*C10G 9/16* (2006.01)
*C10G 9/18* (2006.01)

(52) U.S. Cl. ..... 208/48 Q; 208/102; 208/103; 208/106

(58) Field of Classification Search ..... 208/46, 208/48 R, 48 Q, 95, 100, 102, 103, 106
See application file for complete search history.

(56) References Cited

U.S. PATENT DOCUMENTS

| | | | | |
|---|---|---|---|---|
| 2,343,192 | A | 2/1944 | Kuhn | |
| 2,695,264 | A | 11/1954 | Taff et al. | |
| 2,901,418 | A | 8/1959 | Pappas | |
| 3,498,906 | A | 3/1970 | Bogart et al. | |
| 3,529,030 | A | 9/1970 | Chin | |
| 3,593,968 | A | 7/1971 | Geddes | |
| 3,647,907 | A * | 3/1972 | Sato et al. | 208/48 Q |
| 3,676,519 | A | 7/1972 | Dorn et al. | |
| 3,907,661 | A | 9/1975 | Gwyn et al. | |
| 3,923,921 | A | 12/1975 | Kohfeldt | |
| 3,959,420 | A | 5/1976 | Geddes et al. | |
| 4,107,226 | A | 8/1978 | Ennis, Jr. et al. | |
| 4,121,908 | A | 10/1978 | Raab et al. | |
| 4,150,716 | A * | 4/1979 | Ozaki et al. | 208/48 Q |
| 4,166,830 | A | 9/1979 | Guth et al. | |
| 4,233,137 | A | 11/1980 | Ozaki et al. | |
| 4,279,733 | A | 7/1981 | Gwyn | |
| 4,279,734 | A | 7/1981 | Gwyn | |
| 4,420,343 | A | 12/1983 | Sliwka | |
| 4,444,697 | A | 4/1984 | Gater et al. | |
| 4,446,003 | A | 5/1984 | Burton et al. | |
| 4,457,364 | A | 7/1984 | DiNicolantonio et al. | |
| 4,520,760 | A | 6/1985 | Covell | |
| 4,581,899 | A | 4/1986 | von Klock et al. | |
| 4,614,229 | A | 9/1986 | Oldweiler | |
| 4,702,818 | A * | 10/1987 | Oyamoto et al. | 208/100 |
| 4,945,978 | A | 8/1990 | Herrmann | |
| 5,092,981 | A | 3/1992 | Russo | |
| 5,107,921 | A | 4/1992 | Tsai | |
| 5,139,650 | A | 8/1992 | Lenglet | |
| 5,147,511 | A | 9/1992 | Woebcke | |
| 5,215,649 | A | 6/1993 | Grenoble et al. | |
| 5,271,827 | A | 12/1993 | Woebcke | |
| 5,294,347 | A | 3/1994 | Byrne et al. | |
| 5,324,486 | A | 6/1994 | Russo | |
| 5,579,831 | A | 12/1996 | Brucher | |
| 5,690,168 | A | 11/1997 | Cizmar et al. | |
| 5,756,055 | A | 5/1998 | Kelly et al. | |
| 6,148,908 | A | 11/2000 | Brucher | |
| 6,183,626 | B1 | 2/2001 | Lenglet et al. | |
| 6,271,431 | B1 | 8/2001 | Busson et al. | |
| 6,626,424 | B2 | 9/2003 | Ngan et al. | |
| 2003/0031612 | A1 | 2/2003 | Raynal et al. | |

FOREIGN PATENT DOCUMENTS

| | | |
|---|---|---|
| EP | 0 031 609 | 12/1983 |
| EP | 0 205 205 | 12/1986 |
| EP | 205 205 | 12/1986 |
| EP | 1 063 273 | 12/2000 |
| GB | 1233795 | 5/1971 |
| GB | 1309309 | 3/1973 |
| GB | 1390382 | 4/1975 |
| JP | 2001-40366 | 2/2001 |
| WO | WO 93/12200 | 6/1993 |
| WO | 97/13097 | 4/1997 |
| WO | WO 00/56841 | 9/2000 |

OTHER PUBLICATIONS

R. Mukherjee, Effectively Design Shell-and-Tube Heat Exchangers, 94 Chem. Engr. Progress 21-37 (1998).*

Lohr et al., "Steam-cracker Economy Keyed to Quenching," Oil Gas Journal, vol. 76 (No. 20), pp. 63-68, (1978).

(Continued)

*Primary Examiner*—Glenn Caldarola
*Assistant Examiner*—Randy Boyer

(57) ABSTRACT

A method is provided for treating the effluent from a hydrocarbon pyrolysis unit processing heavier than naphtha feeds to recover heat and remove tar therefrom. The method comprises passing the gaseous effluent to at least one primary transfer line heat exchanger, thereby cooling the gaseous effluent and generating superheated steam. Thereafter, the gaseous effluent is passed through at least one secondary transfer line heat exchanger having a heat exchange surface with a liquid coating on said surface, thereby further cooling the remainder of the gaseous effluent to a temperature at which tar, formed by the pyrolysis process, condenses. The condensed tar is then removed from the gaseous effluent in at least one knock-out drum. An apparatus for carrying out the method is also provided.

26 Claims, 4 Drawing Sheets

OTHER PUBLICATIONS

Kister, Henry Z., *Distillation Design*, Chapter 6 "*Tray Design and Operation*", pp. 259-363, Chapter 8 "*Packing Design and Operation*", pp. 421-521, McGraw-Hill, Inc., Copyright © 1992.

H. Herrmann & W. Burghardt , "Latest Developments in Transfer Line Exchanger Design for Ethylene Plants", Apr. 1994, Schmidt'sche Heissdampf-Gesellschaft, p. 193-228.

* cited by examiner

METHOD FOR PROCESSING HYDROCARBON PYROLYSIS EFFLUENT

CROSS-REFERENCE TO RELATED APPLICATIONS

The present application expressly incorporates by reference herein the entire disclosure of Ser. No. 11/177,975, entitled "METHOD FOR PROCESSING HYDROCARBON PYROLYSIS EFFLUENT" and Ser. No. 11/178,158, entitled "METHOD FOR PROCESSING HYDROCARBON PYROLYSIS EFFLUENT", Ser. No. 11/177,125, entitled "METHOD FOR PROCESSING HYDROCARBON PYROLYSIS EFFLUENT", Ser. No. 11/177,075, entitled "METHOD FOR PROCESSING HYDROCARBON PYROLYSIS EFFLUENT", and Ser. No. 11/178,037, entitled "METHOD FOR PROCESSING HYDROCARBON PYROLYSIS EFFLUENT", which are being concurrently filed with the present application.

FIELD OF THE INVENTION

The present invention is directed to a method for processing the gaseous effluent from hydrocarbon pyrolysis units that can use heavy feeds, e.g., heavier than naphtha feeds, using a primary dry-wall heat exchanger and a secondary wet-wall heat exchanger.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules.

In the steam cracking process, it is desirable to maximize the recovery of useful heat from the process effluent stream exiting the cracking furnace. Effective recovery of this heat is one of the key elements of a steam cracker's energy efficiency.

The steam cracking process, however, also produces molecules which tend to combine to form high molecular weight materials known as tar. Tar is a high-boiling point, viscous, reactive material that, under certain conditions, can foul heat exchange equipment, rendering heat exchangers ineffective. The fouling propensity can be characterized by three temperature regimes.

Above the hydrocarbon dew point (the temperature at which the first drop of liquid condenses), the fouling tendency is relatively low. Vapor phase fouling is generally not severe, and there is no liquid present that could cause fouling. Appropriately designed transfer line heat exchangers are therefore capable of recovering heat in this regime with minimal fouling.

Between the hydrocarbon dew point and the temperature at which steam cracked tar is fully condensed, the fouling tendency is high. In this regime, the heaviest components in the stream condense. These components are believed to be sticky and/or viscous, causing them to adhere to surfaces. Furthermore, once this material adheres to a surface, it is subject to thermal degradation that hardens it and makes it more difficult to remove.

At or below the temperature at which steam cracked tar is fully condensed, the fouling tendency is relatively low. In this regime, the condensed material is fluid enough to flow readily at the conditions of the process, and fouling is generally not a serious problem.

One technique used to cool pyrolysis unit effluent and remove the resulting tar employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas or feedstocks heavier than naphthas, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly, in most commercial liquid crackers, cooling of the effluent from the cracking furnace is normally achieved using a system of transfer line heat exchangers, a primary fractionator, and a water quench tower or indirect condenser. For a typical heavier than naphtha feedstock, the transfer line heat exchangers cool the process stream to about 593° C. (1100° F.), efficiently generating super-high pressure steam which can be used elsewhere in the process. The primary fractionator is normally used to condense and separate the tar from the lighter liquid fraction, known as pyrolysis gasoline, and to recover the heat between about 93° and about 316° C. (200° F. to 600° F.). The water quench tower or indirect condenser further cools the gas stream exiting the primary fractionator to about 40° C. (100° F.) to condense the bulk of the dilution steam present and to separate pyrolysis gasoline from the gaseous olefinic product, which is then sent to a compressor.

Modern quench systems for cooling hot pyrolysis effluent typically employ at least some indirect heat exchange in which furnace effluent is cooled in a heat-exchanger where high pressure boiler feed water is vaporized to produce high pressure steam. High pressure boiler feed water is obtained from a deaerator and is typically provided at pressures ranging from about 4240 to about 13900 kPa (600 to 2000 psig) and temperatures ranging from about 100° C. to about 260° C. (212 to 500° F.). Typical steam pressure levels employed range from about 4240 to about 13893 kPa (600 to 2000 psig). The steam generated in the quench exchangers is typically superheated in the convection section of an associated steam cracking furnace, and the superheated steam is used within the ethylene plant to power large steam turbines that can drive, e.g., major compressors or pumps.

In currently employed quench systems, energy recovered from the heated process gas is limited. As the furnace effluent stream cools, it eventually reaches its dew point, the temperature at which the heaviest cracking by-product components begin to condense, forming materials known as tar, pitch, or non-volatiles, from their precursors present in the furnace effluent stream. Such materials are still highly reactive at the temperatures at which they first condense. When deposited against a relatively hot surface, e.g., a quench exchanger tube wall, these materials continue to cross-link, polymerize and/or dehydrogenate to form an undesirable highly insulating foulant or coke layer on such surface. Yields of tar, pitch or non-volatile components generated in a cracking furnace generally increase as molecular weight of feed to the furnace increases, although the molecular structure of heavy feeds also can influence tar yield. For example, a heavy, highly paraffinic feed may have a lower tar yield than a lighter feed of lower paraffin content, but higher naphthene and/or aromatics content.

Dew point, or the temperature at which condensate is initially formed, of a gaseous effluent from pyrolysis typically increases as the yield of heavy tar components increase. Thus, effluent dew point generally increases as the feed molecular weight increases. Typical effluent dew points are as follows: for ethane cracking, about 149° C. (300° F.), for light virgin naphtha cracking, from about 287° to about 343° C. (550 to 650° F.), for gas oil cracking, from about 399° to about 510° C. (750° to 950° F.), and for vacuum gas oil (VGO) cracking, up to about 566° C. (1050° F.).

Conventional quench exchanger trains are designed to keep the process-side wall temperature, i.e., the exchanger surface in contact with the process gas effluent, at or above the effluent dew point.

Thus, ethane quench systems typically employ steam generating heat exchangers operating at from about 4240 kPa to about 10445 kPa (600 to 1500 psig), with corresponding process-side wall temperatures in the range of from about 253° to about 316° C. (488° to 600° F.). These steam generating quench exchangers cool the furnace effluent to a temperature of about 288° to about 343° C. (550° to 650° F.). Further energy recovery from the furnace effluent can be effected by preheating the boiler feed water supply to the steam generating system, thus further increasing the overall cycle efficiency. So long as the process-side wall temperatures of the high pressure boiler feed water (HPBFW) preheater are maintained above the dew point, fouling is negligible. Thus, ethane furnace effluent can be efficiently quenched and cooled down to about 204° C. (400° F.) without fouling problems.

Modern naphtha furnaces typically employ quench exchangers generating steam at pressures from about 10445 to about 13890 kPa (1500 to 2000 psig). Effluent is typically cooled to a temperature ranging from about 343° to about 399° C. (650° to 750° F.) with negligible fouling occurring as the film temperatures on the process-side heat exchanger surfaces are kept at or above the effluent dew point. However, further cooling in high pressure boiler feed water (HPBFW) preheaters is not practiced because of associated fouling below the dew point. If further cooling is required, a cooling liquid quench medium, e.g., quench oil or water, can be directly injected to achieve the desired temperature without fouling.

For modern gas oil furnaces associated with hydrocarbon pyrolysis, a quench heat exchanger generating steam at pressures from about 10445 to about 13890 kPa (1500 to 2000 psig) can be used. Clean heat exchanger outlet temperatures typically range from about 427° to about 482° C. (800° to about 900° F.), but the exchanger fouls rapidly until the foulant/process gas interface temperature reaches the effluent dew point, at which stage fouling rates slow dramatically. At the end of a typical gas oil run, the heat exchangers will have reached effluent outlet temperatures ranging from about 538° to about 677° C. (1000° to about 1250° F.).

Inasmuch as effluent from a gas oil furnace must be cooled to a temperature ranging from about 287° to about 316° C. (550° to about 600° F.), a liquid quench oil stream is typically mixed with the heat exchanger effluent to achieve such cooling. The heat absorbed by the quench oil can be recovered in a fractionator pump around circuit. However, the relatively low temperature of the pumparound stream, less than about 287° C. (550° F.), yields only medium pressure steam, typically, from about 790 to 1830 kPa (100 to 250 psig) or low pressure steam below about 790 kPa (100 psig). This represents a significant efficiency reduction compared to the generation of high pressure steam, e.g., about 10445 kPa (1500 psig), achieved by furnaces using ethane or other gaseous feedstocks.

The present invention seeks to provide a simplified method for treating pyrolysis unit effluent, particularly the effluent from the steam cracking of hydrocarbonaceous feeds that are heavier than naphthas. Heavy feed cracking is often more economically advantageous than naphtha cracking, but in the past it suffered from poor energy efficiency and higher investment requirements. The present invention optimizes recovery of the useful heat energy resulting from heavy feed steam cracking without fouling of the cooling equipment. This invention can also obviate the need for a conventional primary fractionator tower and its ancillary equipment.

Heavy feed steam cracking effluent can be treated by using a primary heat exchanger, typically a transfer line exchanger, generating high pressure steam to initially cool the furnace effluent. The surfaces of heat exchanger tubes must operate above the hydrocarbon dew point to avoid rapid fouling, typically an average bulk outlet temperature of about 593° C. (about 1100° F.) for a heavy gas oil feedstock. Additional cooling can be provided by directly injecting a quench liquid such as tar or distillate to immediately cool the stream without fouling. Alternatively, the pyrolysis furnace effluent can be directly quenched, e.g., with distillate, which also avoids fouling. However, the former cooling method suffers from the drawback that only a fraction of the heat is recovered in a primary transfer line exchanger; moreover, in both methods, remaining heat removed by direct quenching is recovered at a lower temperature where it is less valuable. Furthermore, additional investment is required in the downstream primary fractionator where low level heat is ultimately removed, and in offsite boilers which must generate the remaining high pressure steam required by the steam cracking plant.

Relevant background art is discussed below.

"Latest Developments in Transfer Line Exchanger Design for Ethylene Plants", H. Herrmann & W. Burghardt, Schmidt'sche Heissdampf-Gesellschaft, prepared for presentation at AIChE Spring National Meeting, Atlanta, April 1994, Paper #23c, as well as U.S. Pat. No. 4,107,226, disclose dew point fouling mechanisms in ethylene furnace quench systems, as well as use of heat exchangers which generate high pressure steam.

U.S. Pat. Nos. 4,279,733 and 4,279,734 propose cracking methods using a quencher, indirect heat exchanger and fractionator to cool effluent, resulting from steam cracking. The latter reference teaches a method utilizing a first stage "dry-wall" quench exchanger cooling the hot process effluent to at least 540° C. (1000° F.) wherein liquid washed quench exchangers recover energy to high pressure steam at temperatures below the dew point of the effluent gas stream.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone and a separating zone. The latter reference teaches a method utilizing liquid washed quench exchangers to recover energy to high pressure steam at temperatures below the dew point of the effluent gas stream, wherein energy recovery to high pressure steam is achievable at 250° to 300° C. (482° to 572° F.), with substantial precooling of the hot effluent to 300° to 400° C. (572° to 752° F.), requiring a high circulation rate of quench, e.g., up to 21:1 quench to hydrocarbon feed, requiring a substantial investment in circulation pumps and pipework as well as associated energy consumption.

U.S. Pat. No. 4,614,229 discloses heat recovery from hot effluent using a primary transfer line exchanger and a secondary transfer line exchanger utilizing wash liquid injected into its tubes to provide process gas cooled to about 550° F. Energy recovery at lower temperature is carried out in a fractionator pumparound circuit, favoring recovery of steam at medium pressures. Liquid collected from the secondary TLE for use as a wash liquid increases the concentration of undesirable heavy, viscous molecules, increasing the effluent dew point and fouling tendencies. Liquid washing of exchanger tubes relies upon uniform flow patterns across the exchanger inlet tubesheet/baffle, which technique is susceptible to degradation of uniform wash liquid distribution over time.

Lohr et al., "Steam-cracker Economy Keyed to Quenching," Oil Gas J., Vol. 76 (No. 20) pp. 63-68 (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two stage quench process for effluent from steam cracking, comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 105° C. to 130° C. (221° F. to 266° F.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

JP 2001040366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841, GB 1,390,382, GB 1,309,309, U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

U.S. Pat. Nos. 4,107,226; 3,593,968; 3,907,661; 3,647,907; 4,444,697; 3,959,420; 4,121,908; and 6,626,424; and Great Britain Patent Application 1,233,795 disclose methods of distributing wash liquids in quench fittings, e.g., annular direct quench fittings.

Given the foregoing, it would be desirable to recover useful heat from steam cracking furnace effluent in the absence of rapid fouling and absent direct quenching in order to minimize overall energy consumption in steam cracking processes used to manufacture light olefins.

SUMMARY OF THE INVENTION

In one aspect, the present invention relates to a method for cooling and recovering energy from tar precursor-containing gaseous effluent from hydrocarbon pyrolysis, the method comprising: (a) passing the gaseous effluent through at least one primary heat exchanger (or dry-wall quench exchanger) to provide a cooled effluent above the temperature at which the tar precursor initially condenses; (b) passing the cooled effluent from (a) through at least one secondary heat exchanger (or wet-wall quench exchanger) comprising a tube having a process side and a shell side, the process side being covered with a substantially continuous liquid film, to provide a gaseous effluent stream of reduced tar content below 287° C. (550° F.), and below the temperature at which the tar precursor initially condenses.

In one configuration of this aspect of the invention, at least a portion of energy recovered by the wet wall quench exchanger is recovered at temperatures below about 282° C. (540° F.), e.g., below about 277° C. (530° F.), say, below about 260° C. (500° F.).

In another configuration of this aspect of the invention, at least about 10%, e.g., at least about 20%, say, at least about 50% of energy recovered by the wet-wall quench exchanger is recovered at temperatures below 287° C. (550° F.).

In yet another configuration of this aspect of the invention, the gaseous effluent is cooled in (a) to a temperature of less than about 704° C. (1300° F.), typically from about 343° to about 649° C. (650° to 1200° F.), and cooled in (b) to a temperature of less than about 282° C. (540° F.), typically from about 177° to about 277° C. (350° to 530° F.).

In still another configuration of this aspect of the invention, the at least one dry-wall quench exchanger is selected from the group consisting of a high pressure steam superheater and a high pressure steam generator.

In yet another configuration of this aspect of the invention, the at least one wet-wall quench exchanger utilizes a wall process side surface sufficiently cooled to effect thereon condensation of liquid from the cooled effluent of (a) so as to provide a self-fluxing film.

In yet still another configuration of this aspect of the invention, the at least one wet-wall quench exchanger utilizes a wall process side surface sufficiently cooled to effect thereon condensation of liquid from the cooled effluent of (a) so as to provide a self-fluxing film. In one embodiment, the self-fluxing film is rich in aromatics, e.g., the self-fluxing film contains at least about 40 wt % aromatics, say, at least about 60 wt % aromatics. In another embodiment, the wet-wall quench exchanger is a shell-and-tube exchanger.

In still yet another configuration of this aspect of the invention, the at least one wet-wall quench exchanger utilizes a substantially uniformly distributed oil wash to provide a wet wall substantially free of dry spots. In one embodiment, the at least one wet-wall quench exchanger utilizes an annular oil distributor at or near the exchanger inlet to distribute quench oil along the quench exchanger wall so as to condense sufficient liquid from said effluent gas to provide a fluxing film. The fluxing film is rich in aromatics, e.g., the fluxing film contains at least about 40 wt % aromatics say, at least about 60 wt % aromatics.

In another configuration of this aspect of the invention, the energy recovered by said wet-wall quench exchanger at temperatures below 287° C. (550° F.) provides steam at a pressure above about 1480 kPa (200 psig), typically at a pressure above about 4240 kPa (600 psig), e.g., ranging from about 4240 kPa to about 7000 kPa (600 psig to 1000 psig).

In still another configuration of this aspect of the invention, the liquid film is derived from condensed gaseous effluent, quench oil, and pyrolysis fuel oil. The quench oil can contain less than about 10 wt % tar, e.g., less than about 5 wt % tar. In one embodiment, the quench oil contains distillate quench distilled from the gaseous effluent from hydrocarbon pyrolysis. In another embodiment, the quench oil is a heavy aromatic solvent substantially free of steam-cracked tar and asphaltenes.

In yet another configuration of this aspect of the invention, the dry-wall quench exchanger provides a wall process side surface sufficiently heated to provide a process gas/wall process side surface interface above the gaseous effluent dew point.

In still another configuration of this aspect of the invention, the wet-wall quench exchanger is selected from the group consisting of high pressure steam generator and high pressure boiler feed water preheater. In one embodiment, the wet-wall quench exchanger utilizes co-current flow of process gas and heat transfer medium. In another embodiment, the wet-wall quench exchanger utilizes counter-current flow of process gas and heat transfer medium. In still another embodiment, the wet-wall quench exchanger is oriented vertically, with process gas flowing downwardly. In yet another embodiment, the wet-wall quench exchanger is a double pipe exchanger. In still yet another embodiment, the wet-wall quench exchanger is a shell-and-tube exchanger.

In yet another configuration of this aspect of the invention, the gaseous effluent from hydrocarbon pyrolysis is obtained by pyrolyzing a feed selected from naphtha, kerosene, condensate, atmospheric gas oil, vacuum gas oil, hydrocrackate, and crude oil which has been treated to remove heavy residue.

In still yet another configuration of this aspect of the invention, the temperature at which said tar precursor initially condenses ranges from about 316° to about 650° C. (600° to 1200° F.), typically from about 371° to about 621° C. (700° to 1150° F.), e.g., about 454° C. (850° F.).

In still yet another configuration of this aspect of the invention, the method further comprises (c) passing said cooled effluent from (b) through an additional wet-wall quench exchanger to provide an effluent stream below about 260° C. (500° F.), whereby at least a portion of the energy recovered by said additional wet-wall exchanger is recovered at temperatures below 260° C. (500° F.). Energy can be recovered in (c) by preheating high pressure boiler feed water to generate steam having a pressure of at least about 4240 kPa (600 psig).

In another aspect, the present invention relates to an apparatus for cooling and recovering energy from tar precursor-containing gaseous effluent from hydrocarbon pyrolysis, comprising: (a) at least one dry-wall quench exchanger through which said gaseous effluent passes to provide a cooled effluent above the temperature at which said tar precursor initially condenses; and (b) at least one wet-wall quench exchanger comprising a tube having a process side and a shell side, said process side being covered with a substantially continuous liquid film, through which the cooled effluent from (a) can be passed through to provide a gaseous effluent stream of reduced tar content below 287° C. (550° F.), and below the temperature at which said tar precursor initially condenses.

In one configuration of this aspect of the invention, the at least one dry-wall quench exchanger is selected from the group consisting of a high pressure steam superheater and a high pressure steam generator. In one embodiment, the at least one wet-wall quench exchanger utilizes a wall process side surface sufficiently cooled to effect thereon condensation of liquid from the cooled effluent of (a) so as to provide a self-fluxing film. Alternately, the at least one wet-wall quench exchanger utilizes a substantially uniformly distributed oil wash means to provide a wet wall substantially free of dry spots. Such a wet-wall quench exchanger can comprise an annular oil distributor at or near the exchanger inlet to distribute quench oil along the quench exchanger wall capable of condensing sufficient liquid from said effluent gas to provide a fluxing film.

In another configuration of this aspect of the invention, the dry-wall quench exchanger provides a wall process side surface which can be sufficiently heated to provide a process gas/wall process side surface interface above the gaseous effluent dew point.

In still another configuration of this aspect of the invention, the wet-wall quench exchanger is selected from the group consisting of high pressure steam generator and high pressure boiler feed water preheater.

In yet another configuration of this aspect of the invention, the apparatus further comprises (c) an additional wet-wall quench exchanger, through which can be passed cooled effluent from (b) to provide an effluent stream below about 260° C. (500° F.), whereby at least a portion of the energy recovered by said additional wet-wall exchanger is recovered at temperatures below 260° C. (500° F.). In one embodiment, the apparatus further comprises a preheater through which energy is recovered from (c) by preheating high pressure boiler feed water to generate steam having a pressure of at least about 4240 kPa (600 psig).

DETAILED DESCRIPTION OF THE EMBODIMENTS

Figure 1:
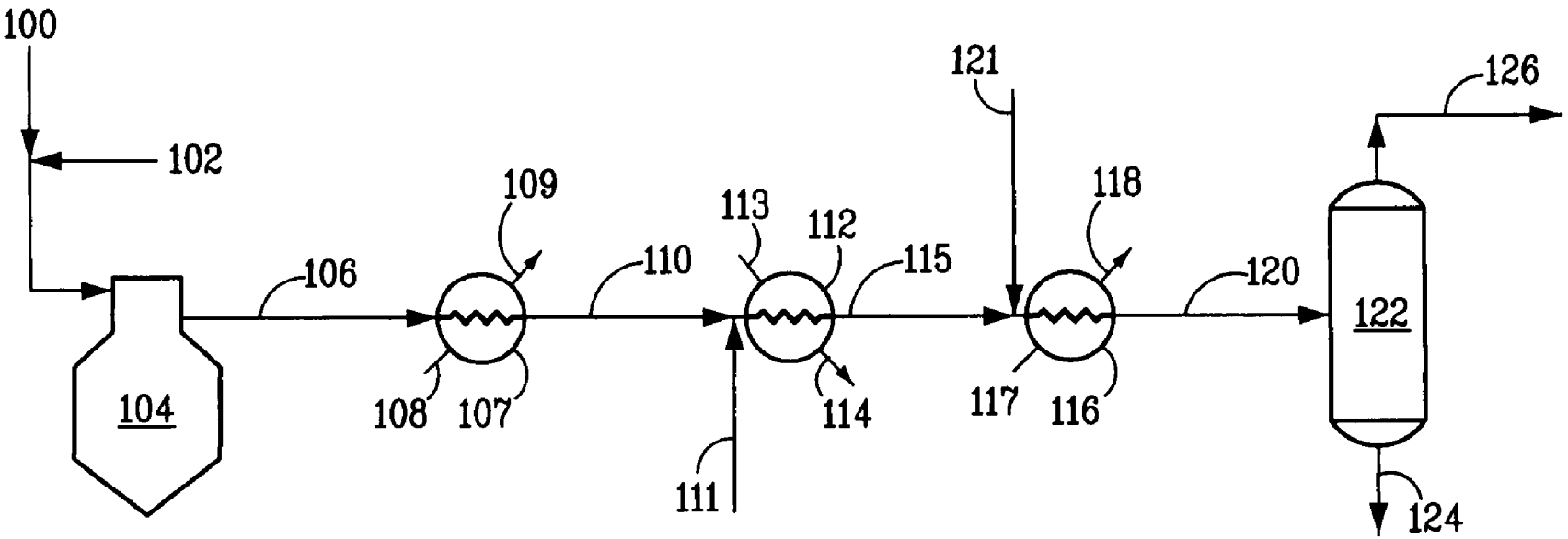
FIG. 1 is a schematic flow diagram of a method according to one example of the present invention of treating the gaseous effluent from the cracking of a feed heavier than naphtha.

The present invention provides a low cost way of treating the gaseous effluent stream from a hydrocarbon pyrolysis reactor so as to remove and recover heat therefrom and to separate $C_5$+ hydrocarbons from the desired $C_2$-$C_4$ olefins in the effluent, while minimizing fouling.

Typically, the effluent used in the method of the invention is produced by pyrolysis of a hydrocarbon feed boiling with a final boiling point in a temperature range from above about 180° C. (356° F.), such as feeds heavier than naphtha. Such feeds include those boiling in the range from about 93° to about 649° C. (from about 200° to about 1200° F.), say, from about from about 204° to about 510° C. (from about 400° to about 950° F.). Typical heavier than naphtha feeds can include heavy condensates, gas oils, kerosene, hydrocrackates, crude oils, and/or crude oil fractions. The temperature of the gaseous effluent at the outlet from the pyrolysis reactor is normally in the range of from about 760° C. to about 930° C. (from about 1400° to about 1706° F.) and the invention provides a method of cooling the effluent to a temperature at which the desired $C_2$-$C_4$ olefins can be compressed efficiently, generally less than about 100° C. (212° F.), for example less than about 75° C. (167° F.), such as less than about 60° C. (140° F.) and typically from about 20° to about 50° C. (68° to about 122° F.).

In particular, the present invention relates to a method for treating the gaseous effluent from the heavy feed cracking unit, which method comprises passing the effluent through at least one primary transfer line heat exchanger, which is capable of recovering heat from the effluent down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service. The primary heat exchanger cools the process stream to a temperature between about 340° C. and about 650° C. (644° and 1202° F.), such as about 370° C. (700° F.), using saturated steam as the cooling medium and generates superheated steam, typically at about 4240 kPa (600 psig).

On leaving the primary heat exchanger, the cooled gaseous effluent is still at a temperature above the hydrocarbon dew point (the temperature at which the first drop of liquid condenses) of the effluent. For a typical heavy feed under certain cracking conditions, the hydrocarbon dew point of the effluent stream ranges from about 343° to about 649° C. (650° to 1200° F.), say, from about 399° to about 593° C. (750° to 1100° F.). Above the hydrocarbon dew point, the fouling tendency is relatively low, i.e., vapor phase fouling is generally not severe, and there is no liquid present that could cause fouling. Tar condenses from such heavy feeds at a temperature ranging from about 204° to about 343° C. (400° to 650° F.), say, from about 232° to about 316° C. (450° to 600° F.), e.g., at about 288° C. (550° F.). The primary heat exchanger (dry-wall quench exchanger) can be a high pressure steam superheater, e.g., of the type described in U.S. Pat. No. 4,279,734. Alternately, the primary heat exchanger can be a high pressure steam generator.

After leaving the primary heat exchanger, the effluent is then passed to at least one secondary heat exchanger (or wet-wall quench exchanger) which is designed and operated such that it includes a heat exchange surface cool enough to condense part of the effluent and generate a liquid hydrocarbon film at the heat exchange surface. In one embodiment, the liquid film is generated in-situ and is preferably at or below the temperature at which tar is fully condensed, typically at about 204° C. to about 287° C. (400° to 550° F.), such as at about 260° C. (500° F.). This is ensured by proper choice of cooling medium and exchanger design. Alternately, the secondary transfer line heat exchanger can be quench-assisted by introducing a limited quantity of quench oil via a separate line, using a suitable distribution apparatus, e.g. an annular oil distributor, to generate an aromatic-rich hydrocarbon oil film that fluxes away tar as the heaviest components of the furnace effluent condense. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a wet-wall quench exchanger must cool the process stream continuously to the temperature at which tar is produced. If the cooling is stopped before this point, fouling is likely to occur because the process stream would still be in the fouling regime. The wet-wall quench exchanger can be a high pressure steam generator as described above, or a high pressure boiler feed water preheater. In either case, the presence of a continuous liquid film prevents heavy components of the furnace effluent from fouling the exchangers. The use of a high pressure boiler feed water preheater in the quench system allows energy to be recovered at temperatures below 287° C. (550° F.), while still contributing to the generation of high pressure steam.

The invention will now be more particularly described with reference to the accompanying drawings.

Figure 2:
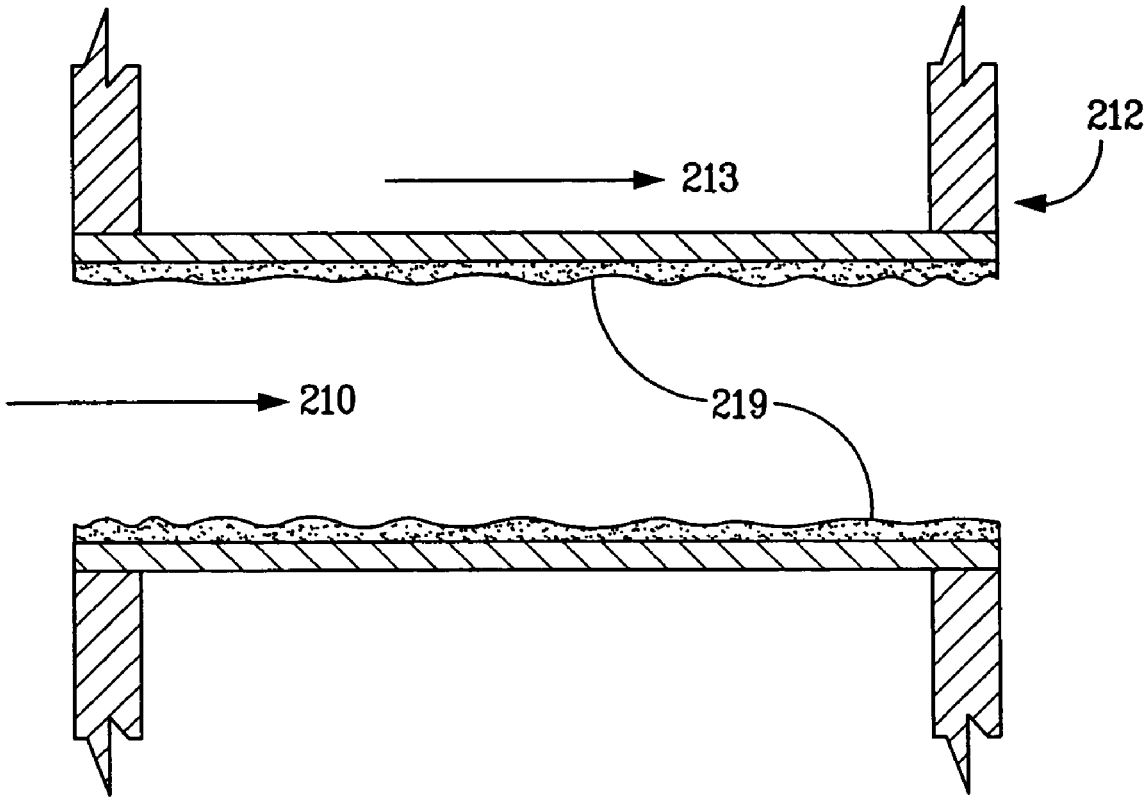
FIG. 2 is a sectional view of one tube of a wet transfer line heat exchanger employed in the method shown in FIG. 1.

Referring to FIGS. 1 and 2, in the method shown which recovers heat from furnace effluent in at least two stages to provide high pressure steam, a hydrocarbon feed 100 comprising heavy gas oil obtained from a paraffinic crude oil and dilution steam 102 is fed at a rate of 66000 kg/hr (145000 pounds/hr) with a dilution steam ratio of 0.5 kg/kg (lb/lb) to a steam cracking reactor 104 where the hydrocarbon feed and dilution stream 102 is heated to cause thermal decomposition of the feed to produce lower molecular weight hydrocarbons, such as $C_2$-$C_4$ olefins. The pyrolysis process in the steam cracking reactor 104 also produces some tar.

Gaseous pyrolysis effluent 106 exiting the steam cracking furnace 104 initially passes through at least one primary transfer line heat exchanger 107 which cools the effluent from an inlet temperature ranging from about 704° C. to about 927° C. (1300° F. to 1700° F.), say, from about 760° C. to about 871° C. (1400° F. to 1600° F.), e.g., about 816° C. (about 1500° F.), to an outlet temperature ranging from about 316° C. to about 704° C. (about 600° F. to about 1300° F.), say, from about 371° C. to about 649° C. (700° F. to 1200° F.), e.g., about 538° C. (1000° F.). The outlet temperature of this exchanger rises rapidly from about 443° to about 527° C. (830° to 980° F.), and then more slowly to about 549° C. (1020° F.). The furnace effluent 106 has a dew point of about 454° C. (850° F.). The effluent 106 from the cracking furnace 104 typically has a pressure of about 210 kPa (15 psig). The primary heat exchanger 107 comprises a boiler feed water inlet 108 for introducing high pressure boiler feed water ranging from about 4240 kPa to about 13893 kPa (600 to 2000 psig), say, about 10450 kPa (1500 psig), and having a temperature ranging from about 121° C. to about 336° C. (250° F. to 636° F.), e.g., about 316° C. (600° F.). High pressure steam at essentially the same pressure as the inlet boiler feed water is taken from steam outlet 109. After leaving the primary heat exchanger 107, the cooled effluent stream 110 is then fed to at least one secondary transfer line heat exchanger 112, where the effluent 110 is cooled on the tube side of the heat exchanger 112 while boiler feed water introduced via line 113 is preheated and vaporized on the shell side of the heat exchanger 112. In one embodiment, the heat exchange surfaces of the exchanger 112 are cool enough to generate a liquid film in situ at the surface of the tube, the liquid film resulting from condensation of the gaseous effluent. Alternately, the secondary transfer line heat exchanger can be quench-assisted by introducing a limited quantity of quench oil, e.g., 20500 kg/hr (45000 lb/hr), via line 111, using a suitable distribution apparatus, e.g. an annular oil distributor, to generate an aromatic-rich hydrocarbon oil film that fluxes away tar as the heaviest components of the furnace effluent condense. The mixture of furnace effluent and quench oil is cooled to an outlet temperature of about 343° C. (650° F.), generating additional 10450 kPa (1500 psig) steam taken off via line 114

FIG. 2 depicts co-current flow of the effluent 210 (corresponding to effluent 110 in FIG. 1, etc.) and boiler feed water 213 to minimize the temperature of the film 219 at the process side inlet; other arrangements of flow are possible, including countercurrent flow. Because heat transfer is rapid between the boiler feed water and the tube metal, the tube metal is just slightly hotter than the boiler feed water 213 at any point in the heat exchanger 212. Heat transfer is also rapid between the tube metal and the liquid film 219 on the process side, and therefore the film temperature is just slightly hotter than the tube metal temperature at any point in heat exchanger 212. Along the entire length of the heat exchanger 212, the film temperature is below the temperature at which tar is fully condensed. This ensures that the film is completely fluid, and thus fouling is avoided.

Reverting to FIG. 1, on leaving the heat exchanger 112, the cooled gaseous effluent 115 can pass to an additional secondary quench exchanger (or tertiary quench exchanger) 116 which can be quench-assisted by introducing a very limited quantity of quench oil, e.g., 6800 kg/hr (15000 lb/hr), via line 121, using a suitable distribution apparatus, e.g. an annular oil distributor, to generate an aromatic-rich hydrocarbon oil film that fluxes away tar as the heaviest components of the furnace effluent condense. A limited amount of quench oil is used in order to ensure a continuous oil film on the wall, given that the effluent has already been cooled below its dew point. The mixture of furnace effluent and quench oil is cooled to an outlet temperature of about 260° C. (500° F.) by preheating high pressure boiler feed water introduced via line 117 which is taken off via line 118.

Preheating high pressure boiler feed water in the heat exchanger 116 is one of the most efficient uses of the heat generated in the pyrolysis unit. Following deaeration, boiler feed water is typically available at a temperature ranging from about 104° C. to about 149° C. (220° F. to 300° F.), say, from about 116° C. to about 138° C. (240° F. to 280° F.), e.g., about 132° C. (270° F.). Boiler feed water from the deaerator can therefore be preheated in the wet transfer line heat exchanger 112. All of the heat used to preheat boiler feed water will increase high pressure steam production. The quench system will generate about 43200 kg/hr (95000 lb/hr) of 10450 kPa (1500 psig) steam which can be superheated to about 950° F. (510° C.).

On leaving the heat exchanger 116, the cooled gaseous effluent 120 is at a temperature where the tar condenses and is then passed into at least one tar knock-out drum 122 where the effluent is separated into a tar and coke fraction 124 and a gaseous fraction 126.

The hardware for the heat exchangers 112 and 116 may be similar to that of a secondary transfer line exchanger often used in gas cracking service. A shell and tube exchanger can be used. The process stream can be cooled on the tube side in a single pass, fixed tubesheet arrangement. A relatively large tube diameter would allow coke produced upstream to pass through the exchanger without plugging. The design of the exchanger 112 and 116 may be arranged to minimize the temperature and maximize thickness of the film 219, for example, by adding fins to the outside surface of the heat exchanger tubes. Boiler feed water could be preheated on the shell side in a single pass arrangement. Alternatively, the shell side and tube side services could be switched. Either co-current or counter-current flow could be used, provided that the film temperature is kept low enough along the length of the exchanger.

Figure 3:
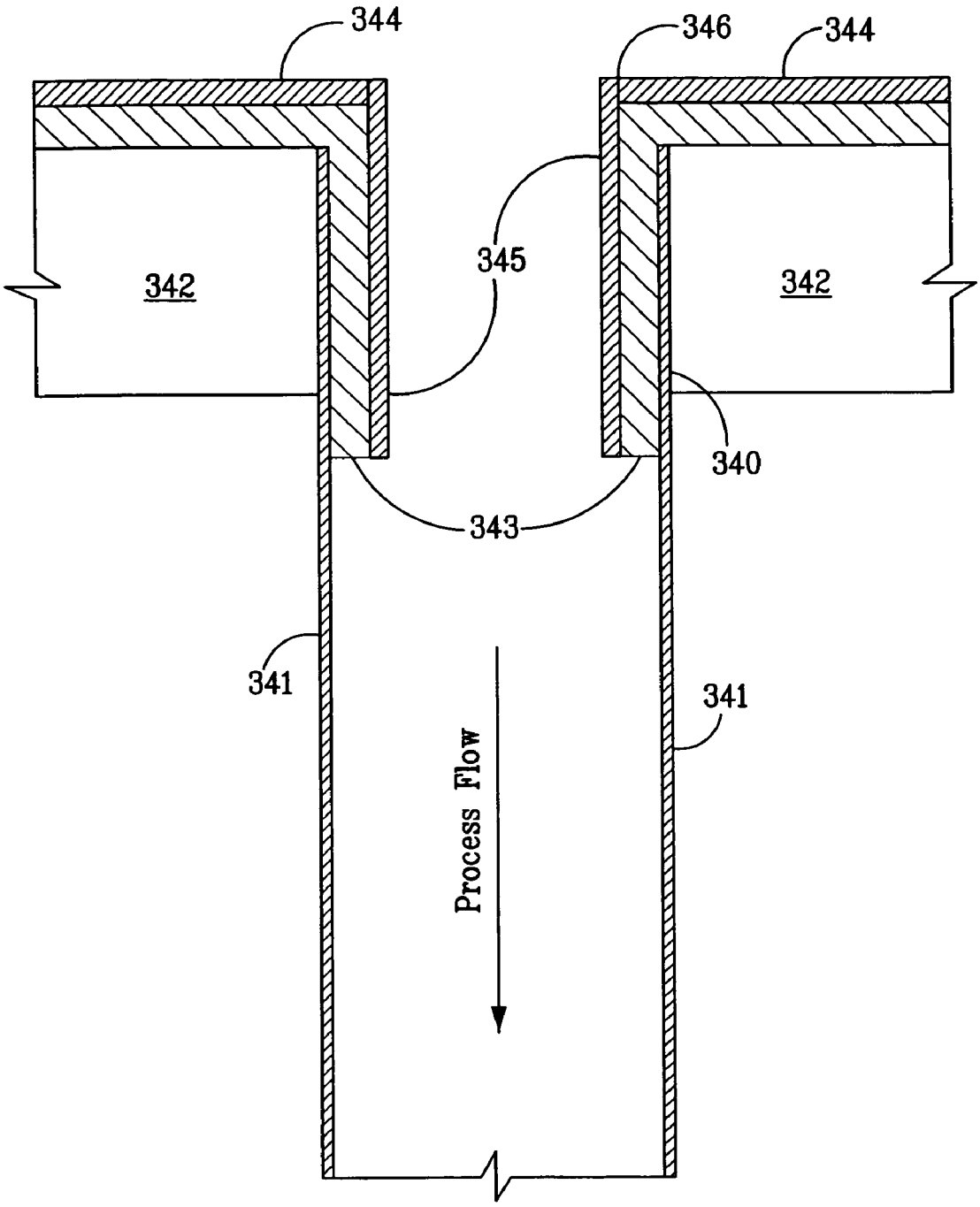
FIG. 3 is a sectional view of the inlet transition piece of a shell-and-tube wet transfer line heat exchanger employed in the method shown in FIG. 1.

For example, the inlet transition piece of a suitable shell-and-tube wet transfer line exchanger is shown in FIG. 3. A heat exchanger tube 341 is fixed in an aperture 340 in a tubesheet 342. A tube insert or ferrule 345 is fixed in an aperture 346 in a false tubesheet 344 positioned adjacent tubesheet 342 such that the ferrule 345 extends into the tube 341 with a thermally insulating material 343 being placed between the tubesheet 342 and the false tubesheet 344 and between the tube 341 and the ferrule 345. With this arrangement, the false tubesheet 344 and ferrule 345 operate at a temperature very close to the process inlet temperature while the tube 341 operates at a temperature very close to that of the cooling medium. Accordingly, little fouling will occur on the tubesheet 344 and the ferrule 345 because they operate above the dew point of the pyrolysis effluent. Similarly, little fouling will occur on the surface of the tube 341 because it operates below the temperature at which the tar fully condenses. This arrangement provides a very sharp transition in surface temperatures to avoid the fouling temperature regime between the hydrocarbon dew point and the temperature at which the tar fully condenses.

Alternatively, the hardware for the secondary transfer line exchanger may be similar to that of a close coupled primary transfer line exchanger. A tube-in-tube exchanger could be used. The process stream could be cooled in the inner tube. A relatively large inner tube diameter would allow coke produced upstream to pass through the exchanger without plugging. Boiler feed water could be preheated in the annulus between the outer and inner tubes. Either co-current or counter-current flow could be used, provided that the film temperature is kept low enough along the length of the exchanger.

Figure 4:
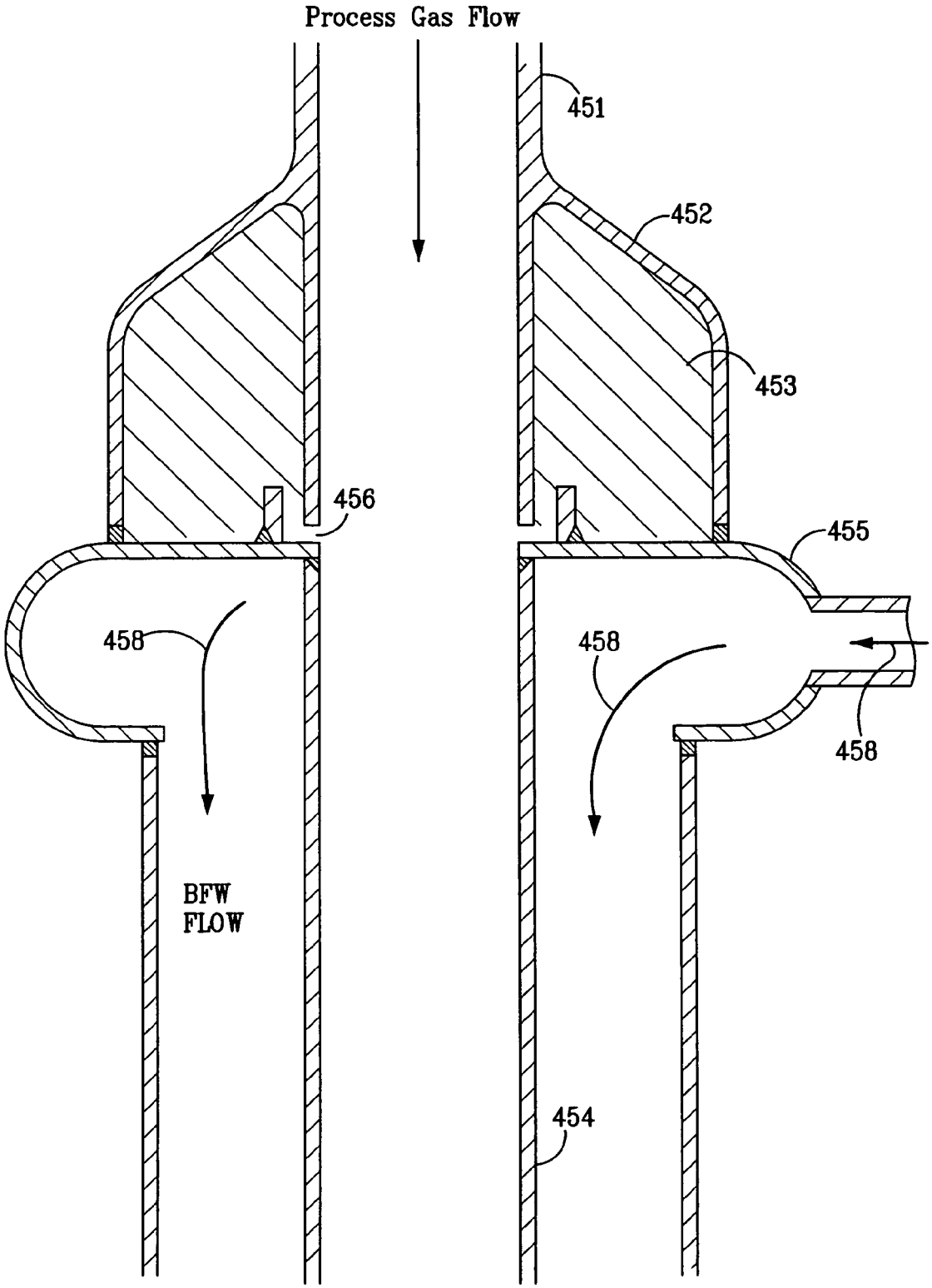
FIG. 4 is a sectional view of the inlet transition piece of a tube-in-tube wet transfer line heat exchanger employed in the method shown in FIG. 1.

For example, the inlet transition piece of a suitable tube-in-tube wet transfer line exchanger is shown in FIG. 4. An exchanger inlet line 451 is attached to swage 452 which is attached to a boiler feed water inlet chamber 455. Insulating material 453 fills the annular space between the exchanger inlet line 451, swage 452, and boiler feed water inlet chamber 455. Heat exchanger tube 454 is attached to boiler feed water inlet chamber 455 which receives boiler feed water 458 such that there is a small gap 456 between the end of inlet line 451 and the beginning of heat exchanger tube 454 to allow for thermal expansion. A similar arrangement, although incorporating a wye-piece in the process gas flow piping, is described in U.S. Pat. No. 4,457,364, whose entire contents are incorporated herein by reference. The entire exchanger inlet line 451 operates at a temperature very close to the process temperature while the exchanger tube 454 operates at a temperature very close to that of the cooling medium. Accordingly, little fouling will occur on the surface of the exchanger inlet line 451 because it operates above the dew point of the pyrolysis effluent. Similarly, little fouling will occur on the heat exchanger tube 454 because it operates below the temperature at which the tar fully condenses. Again this arrangement provides a very sharp transition in surface temperatures to avoid the fouling temperature regime between the hydrocarbon dew point and the temperature at which the tar fully condenses.

The secondary transfer line exchanger may be oriented such that the process flow is either substantially horizontal, substantially vertical upflow, or, preferably, substantially vertical downflow. A substantially vertical downflow system helps ensure that the in situ liquid film remains fairly uniform over the entire inside surface of the heat exchanger tube, thereby minimizing fouling. In contrast, in a horizontal orientation the liquid film will tend to be thicker at the bottom of the heat exchanger tube and thinner at the top because of the effect of gravity. In a vertical upflow arrangement, the liquid film may tend to separate from the tube wall as gravity tends to pull the liquid film downward. Another practical reason favoring a vertical downflow orientation is that the inlet stream exiting the primary transfer line exchanger is often located high up in the furnace structure, while the outlet stream is desired at a lower elevation. A downward flow secondary transfer line exchanger would naturally provide this transition in elevation for the stream.

The secondary transfer line exchanger may be designed to allow decoking of the exchanger using steam or a mixture of steam and air in conjunction with the furnace decoking system. When the furnace is decoked, using either steam or a mixture of steam and air, the furnace effluent would first pass through the primary transfer line exchanger and then through the secondary transfer line exchanger prior to being disposed of to the decoke effluent system. With this feature, it is advantageous for the inside diameter of the secondary transfer line exchanger tubes to be greater than or equal to the inside diameter of the primary transfer line exchanger tubes. This ensures that any coke present in the effluent of the primary transfer line exchanger will readily pass through the secondary transfer line exchanger tube without causing any restrictions.

In the absence of added liquid quench, care should be taken to avoid excessive exchanger wall temperatures, especially in smaller reactors. When the invention was carried out using a small scale pilot reactor of about 0.25 inch (0.64 cm) internal diameter in the absence of added liquid quench, using a 500-800° F. (260-427° C.) wall temperature resulted in rapid coking and corresponding pressure drop when quenching cracked gasoil without liquid assist, providing a run of only about ten minutes. At wall temperatures of about 275° F. (135° C.) and 130° F. (54° C.), runlength increased 5 and 6-7 times, respectively, with no detectable pressure rise for most of the run.

The quench system of the present invention can generate about one and a half times the amount of high pressure steam, produced by conventional techniques. It can achieve this while using less than half the quench oil conventionally required, thus reducing the energy required to pump the quench oil as well. Thus, the present invention provides a low cost way of treating the gaseous effluent stream from a hydrocarbon pyrolysis reactor so as to remove and recover heat therefrom efficiently.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

The invention claimed is:

1. A method for cooling and recovering energy from tar precursor-containing gaseous effluent from hydrocarbon pyrolysis, the method comprising:

(a) passing said gaseous effluent obtained by steam cracking feeds that are heavier than naphthas, through at least one dry-wall quench exchanger in the absence of added liquid quench to provide, by indirect heat exchange, a cooled effluent consisting of gas above the temperature at which said tar precursor initially condenses;

(b) passing the cooled effluent from (a) through at least one wet-wall quench exchanger comprising a tube having a process side and a shell side, said process side being covered with a substantially continuous liquid film, to provide a gaseous effluent stream of reduced tar content below 287° C. (550° F.), and below the temperature at which said tar precursor initially condenses, the at least one wet-wall quench exchanger further comprising an inlet transition piece comprising thermally insulating material.

2. The method of claim 1, whereby at least a portion of energy recovered by said wet-wall quench exchanger is recovered at temperatures below about 282° C. (540° F.).

3. The method of claim 1, whereby at least about 10% of energy recovered by said wet-wall quench exchanger is recovered at temperatures below 287° C. (550° F.).

4. The method of claim 1, whereby at least about 50% of energy recovered by said wet-wall quench exchanger is recovered at temperatures below 287° C. (550° F.).

5. The method of claim 1 wherein the gaseous effluent is cooled in (a) to a temperature of less than about 704° C. (1300° F.), and cooled in (b) to a temperature of less than about 282° C. (540° F.).

6. The method of claim 1 wherein the gaseous effluent is cooled in (a) to a temperature ranging from about 343° to about 649° C. (650° to 1200° F.), and cooled in (b) to a temperature ranging from about 177° to about 277° C. (350° to 530° F.).

7. The method of claim 1 wherein said at least one wet-wall quench exchanger utilizes a wall process side surface sufficiently cooled to effect thereon condensation of liquid from the cooled effluent of (a) so as to provide a self-fluxing film.

8. The method of claim 7 wherein said self-fluxing film contains at least about 40 wt % aromatics.

9. The method of claim 7 wherein said wet-wall quench exchanger is at least one of a shell-and-tube exchanger and a double pipe exchanger.

10. The method of claim 1 wherein said at least one wet-wall quench exchanger utilizes an annular oil distributor at or near the exchanger inlet to distribute quench oil along the quench exchanger wall so as to condense sufficient liquid from said effluent gas to provide a fluxing film.

11. The method of claim 10 wherein said fluxing film is rich in aromatics.

12. The method of claim 11 wherein said fluxing film contains at least about 40 wt % aromatics.

13. The method of claim 1 wherein said energy recovered by said wet-wall quench exchanger at temperatures below 287° C. (550° F.) provides steam at a pressure above about 1480 kPa (200 psig).

14. The method of claim 1 wherein said liquid film is derived from condensed gaseous effluent, quench oil, and pyrolysis fuel oil.

15. The method of claim 14 wherein said quench oil contains less than about 10 wt% tar.

16. The method of claim 15 wherein the quench oil contains distillate quench distilled from the gaseous effluent from hydrocarbon pyrolysis.

17. The method of claim 15 wherein the quench oil contains heavy aromatic solvent substantially free of steam-cracked tar and asphaltenes.

18. The method of claim 1 wherein said dry-wall quench exchanger provides a wall process side surface sufficiently heated to provide a process gas/wall process side surface interface above the gaseous effluent dew point.

19. The method of claim 1 wherein said wet-wall quench exchanger is selected from the group consisting of high pressure steam generator and high pressure boiler feed water preheater.

20. The method of claim 19 wherein said wet-wall quench exchanger utilizes co-current flow of process gas and heat transfer medium.

21. The method of claim 19 wherein said wet-wall quench exchanger utilizes counter-current flow of process gas and heat transfer medium.

22. The method of claim 19 wherein said wet-wall quench exchanger is oriented vertically, with process gas flowing downwardly.

23. The method of claim 1 wherein said gaseous effluent from hydrocarbon pyrolysis is obtained by pyrolyzing a feed selected from naphtha, kerosene, condensate, atmospheric gas oil, vacuum gas oil, hydrocrackate, and crude oil which has been treated to remove heavy residue.

24. The method of claim 1 wherein said temperature at which said tar precursor initially condenses ranges from about 316° to about 654° C. (600° to 1200° F.).

25. The method of claim 1 which further comprises (c) passing said cooled effluent from (b) through an additional wet-wall quench exchanger, to provide an effluent stream below about 260° C. (500° F.), whereby at least a portion of the energy recovered by said additional wet-wall exchanger is recovered at temperatures below 260° C. (500° F.).

26. The method of claim 1 wherein said process side of the wet-wall quench exchanger is below the temperature at which the tar fully condenses.

* * * * *